US006679764B2

(12) United States Patent
Finkenzeller et al.

(10) Patent No.: US 6,679,764 B2
(45) Date of Patent: Jan. 20, 2004

(54) SUPPLY SYSTEM FOR CHEMICALS AND ITS USE

(75) Inventors: Ulrich Finkenzeller, Deutschland (DE); Claus Dusemund, Deutschland (DE); Thomas Schwortschik, Deutschland (DE)

(73) Assignee: Merck Patent GmbH, Darmstadt (DE)

( * ) Notice: Subject to any disclaimer, the term of this patent is extended or adjusted under 35 U.S.C. 154(b) by 284 days.

(21) Appl. No.: 09/793,683

(22) Filed: Feb. 27, 2001

(65) Prior Publication Data

US 2001/0006882 A1 Jul. 5, 2001

Related U.S. Application Data

(63) Continuation of application No. 09/403,096, filed on Mar. 15, 2000, now abandoned.

(30) Foreign Application Priority Data

Apr. 17, 1997 (DE) ..... 197 15 974

(51) Int. Cl.[7] ..... B24B 7/19

(52) U.S. Cl. ..... 451/60; 451/36; 451/28; 451/99; 451/446

(58) Field of Search ..... 451/36, 60, 99, 451/271, 446, 28

(56) References Cited

U.S. PATENT DOCUMENTS

| | | | |
|---|---|---|---|
| 3,500,591 | A | 3/1970 | Gawronski et al. |
| 4,059,929 | A | 11/1977 | Bishop |
| 4,242,841 | A | 1/1981 | Ushakov et al. |
| 4,678,119 | A | 7/1987 | Doyle |
| 5,957,759 | A | 9/1999 | Cardenas et al. |

FOREIGN PATENT DOCUMENTS

| | | |
|---|---|---|
| DE | 2336735 | 2/1975 |
| EP | 0709166 | 5/1996 |
| FR | 2082255 | 12/1971 |

*Primary Examiner*—George Nguyen
(74) *Attorney, Agent, or Firm*—Millen, White, Zelano & Branigan, P.C.

(57) ABSTRACT

The present invention relates to a novel supply system for chemicals which permits the preparation of solid-containing suspensions, which are required, inter alia, for polishing wafers or in semiconductor production, directly at the point of use.

15 Claims, 1 Drawing Sheet

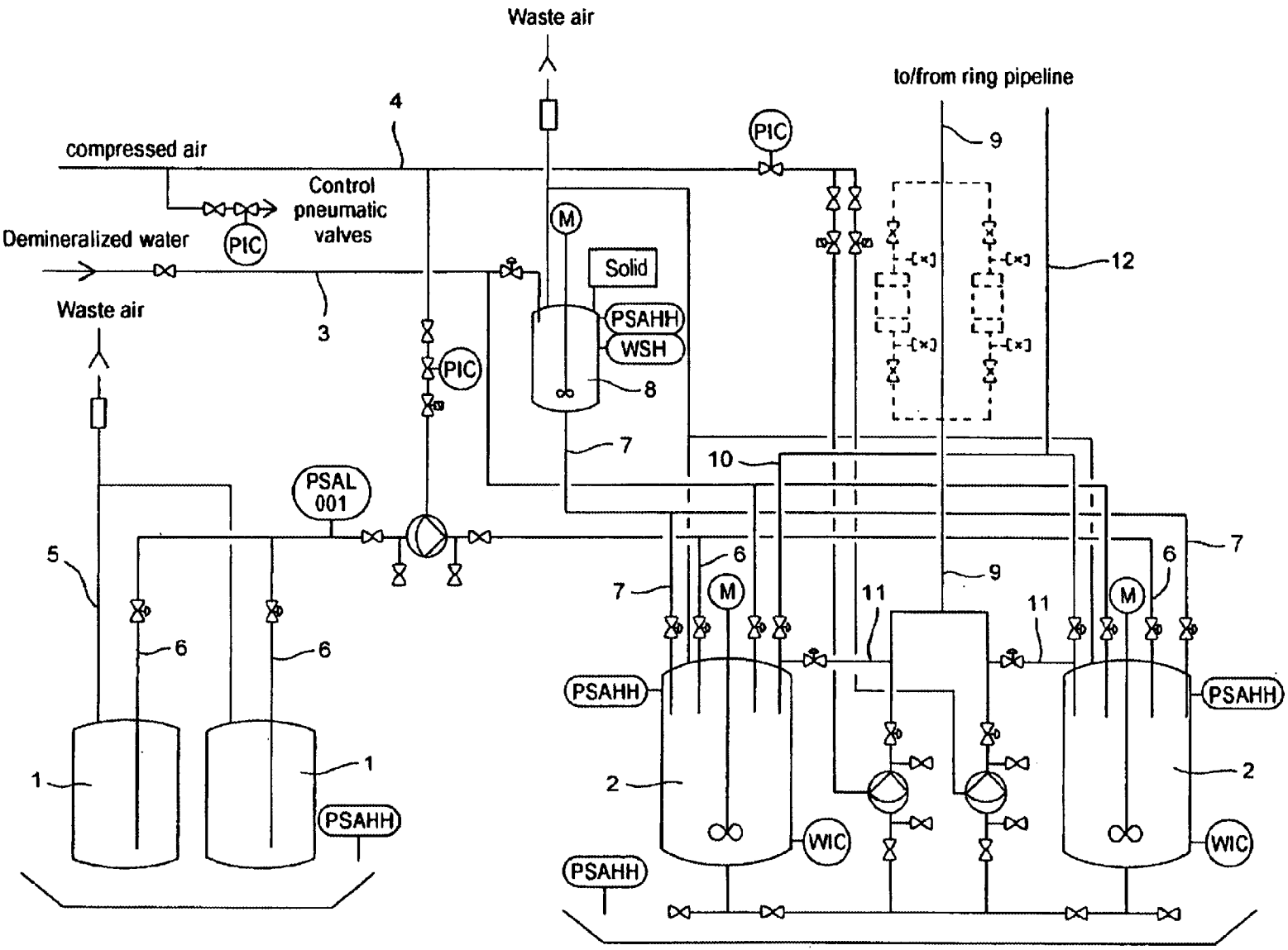
to/from ring pipeline
12
9
9
11
11
10
7
7
7
6
6
6
6
6
2
2
1
1
PSAHH
PSAHH
PSAHH
PSAHH
WIC
WIC
M
M
M
PIC
PIC
PIC
PSAHH
WSH
Solid
8
Waste air
Waste air
4
3
5
Control pneumatic valves
compressed air
Demineralized water
PSAL 001

SUPPLY SYSTEM FOR CHEMICALS AND ITS USE

This is a continuation of Ser. No. 09/403,096 filed on Mar. 15, 2000 now abandoned.

The present invention relates to a novel supply system for chemicals which permits the preparation of solid-containing suspensions, which are required, inter alia, for polishing wafers or in a semiconductor production, directly at the point of use.

Typical semiconductor circuits are usually produced by using silicon or gallium arsenide as a substrate, on which a large number of integrated circuits are applied. The various layers from which these integrated circuits are produced are either conducting or insulating or have semiconductor properties. In order to produce such a semiconductor structure, it is essential for the wafer used to have an absolutely level surface. It is therefore frequently necessary to polish the surface or a part of the surface of a wafer.

Further developments in semiconductor technology have led to greater and greater integration depths and a progressive miniaturization combined with increasingly small semiconductor structures, with the result that the manufacturing methods have to meet growing requirements. In such semiconductor elements, it is necessary, for example, to form thin conductor tracks or similar structures on structures formed beforehand. Problems arise because the surface of the structures formed beforehand is frequently irregular. In order to be able to obtain a satisfactory result in the subsequent photolithographic treatment, the surface must therefore be made planar.

The methods and means by which repeatedly necessary planarity is achieved are therefore a key subject in semiconductor production. The technical term used for this process is chemical-mechanical polishing. Accordingly, both the technical apparatuses used and the chemical components used of which the formulations of the polishing suspensions used are composed, as well as the supply systems with the aid of which the latter are provided during polishing, are therefore of considerable interest in this process step.

In general, chemical-mechanical polishing (CMP) is carried out by polishing the rotating wafer under uniform pressure and rotation with a polishing pad which is uniformly impregnated with a polishing suspension.

In semiconductor production, chemical-mechanical polishing steps are also being used to an increasing extent. They serve for imparting planarity to metallizing tracks on silica layers or other surface structures on wafers. Special CMP slurries, i.e. abrasive, liquid media, are used in this connection. These media must be combined by means of supply systems for chemicals. It is particularly important that these supply systems are capable of providing continuously at the point of use suspensions having constant properties, i.e. in particular having a constant concentration of solid particles and a constant average distribution of the particle diameters. The latter is of particular importance since uniform polishing results are dependent thereon.

Corresponding systems known to date to a person skilled in the art meet the technical requirements only to a limited extent, if at all.

A particular problem arises out of the considerable sedimentation in some solid-containing suspensions, possibly during storage but in particular also in pipelines which lead to the point of use, so that considerable problems may arise with regard to transport and use of raw materials and of the prepared suspensions in the supply system.

Furthermore, in the design of known systems, the handling of faults was taken into account only to an insufficient extent, if at all, so that pipes can readily become blocked due to sedimentation, operation cannot be terminated after a fault or the system can be put into operation again only with very great difficulty. This means that known systems are not available again or are available again only to an insufficient extent after operating faults.

It is the object of the present invention to provide, by simple means, a supply system for chemicals during chemical-mechanical polishing, which system on the one hand employs simple measures to overcome problems which may arise due to the sedimentation of solids but on the other hand, when faults occur, also provides precautions to permit a mode of operation which enables an operation in progress to be completed and therefore permits simple resumption of operation.

The present object is achieved by a supply system for chemicals during chemical-mechanical polishing, consisting of a system of a) storage and working tanks which are connected to one another in a redundant manner and which, if required, are provided with stirrers or other apparatuses for homogeneous mixing and, if required, can be subjected to pressure, b) by pipelines which are provided with valves, are laid in a descending manner and, if required, can be subjected to pressure, c) if required, a compressed air supply suitable for highly pure chemicals and d) if required, a system for supplying highly pure water.

Pipelines of this supply system in which solid-containing media are conveyed are, if required, provided with static mixers.

Laying of the pipelines in a descending manner makes it possible, in the case of faults, such as, for example, in the event of failure of pumps or insufficient flow rate in the pipelines, to convey chemicals or mixtures thereof back to storage tanks under the action of gravity. If necessary, the chemicals or mixtures thereof can be conveyed back to storage tanks by application of compressed air.

To avoid contaminations during the operation, the system can be subjected to pressure, in particular to slightly superatmospheric pressure of about 0.3 to 5 bar.

According to the invention, all system components coming into contact with the chemicals used are produced from materials which are inert to both strongly acidic and strongly basic oxidizing media. Preferably, these components are produced from materials which are resistant to chemicals and are selected from the group consisting of the completely or partially fluorinated or nonfluorinated polymeric hydrocarbons. The choice of the materials used is based on the condition that highly pure chemicals used must not suffer any losses of quality due to abrasion or dissolution of undesired particles.

In particular, this supply system can be used for the preparation of suspensions for chemical-mechanical polishing.

In an embodiment according to the invention, it is suitable in particular for the direct supply of suspensions for chemical-mechanical polishing at the point of use, preferably for the preparation of suspensions for chemical-mechanical polishing which are required for the production of wafers or semiconductor circuits.

BRIEF DESCRIPTION OF THE DRAWINGS

FIG. 1 represents a schematic of the invention, in which the numerals have the following meaning:

(1) intermediate containers for solid (2) storage or working tanks (3) line for supplying liquid (4) line supplying compressed air for pressurizing pipeline (5) line for waste air removal (6) line carrying solid to tanks (2)

(7) line supplying solid, e.g. $Al_2O_3$ (8) tank for solid, e.g. $Al_2O_3$ (9) line supplying slurry to ring pipeline (dotted lines represent optional filter units)

(10) connector line between various tanks (2) and supplying ring pipeline thru line (11) and (9) or through (12) which can be pressurized by air from line (4)

(11) line supplying ring pipeline (bypass for start-up and re-circulation)

(12) line supplying ring pipeline and return to supply tank from ring pipeline.

The present invention also relates to a process for operating the supply system, in which a) one or more metered amounts of solid are taken in one or more intermediate containers (1) and b) are converted into a pasty or liquid form with mixing, by adding one or more liquids supplied through line (3), and c) are introduced into one or more storage or working tanks (2) in which, if required, further chemicals required in the operation have already been placed.

What is claimed is:

1. A supply system for chemicals during chemical-mechanical polishing, comprising a) storage and working tanks which are connected to one another and which are optionally provided with stirrers or homogeneous mixing devices and can optionally be subjected to pressure, b) pipelines which are provided with valves, laid in a descending manner and which optionally can be subjected pressure, c) an optional compressed air supply suitable for highly pure chemicals and d) an optional system for supplying highly pure water.

2. The supply system according to claim 1, wherein the pipelines are provided with static mixers.

3. The supply system according to claim 1, wherein laying the pipelines in a descending manner makes it possible to convey said chemicals back to storage tanks by the action of gravity.

4. The supply system according to claim 1, wherein said chemicals can be conveyed back to storage tanks by application of compressed air.

5. The supply system according to claim 1, which is under pressure during operation.

6. The supply system according to claim 5, operated at a slightly superatmospheric pressure of 0.3 to 5 bar.

7. The supply system according to claim 1, wherein all portions of the supply system coming into contact with the chemicals used are produced from materials which are inert to both strongly acidic and strongly basic oxidizing media, so that contamination of the chemicals by abrasion or dissolution of particles is avoided.

8. The supply system according to claim 7, wherein all portions of the supply system coming into contact with the chemicals used are produced from materials which are resistant to chemicals and comprise completely or partially fluorinated or nonfluorinated polymeric hydrocarbons.

9. A process for the preparation of suspensions for chemical-mechanical polishing, comprising preparing a suspension by combining solids and liquid in a) storage and working tanks which are connected to one another and which, are optionally provided with stirrers or homogeneous mixing devices and can optionally be subjected to pressure, b) pipelines which are provided with valves, laid in a descending manner and which optionally can be subjected pressure, connected to c) an optional compressed air supply suitable for highly pure chemicals and d) an optional system for supplying highly pure water.

10. A process for supplying suspensions for chemical-mechanical polishing a point of use, comprising supplying said suspensions from a) storage and working tanks which are connected to one another and which are optionally provided with stirrers or homogeneous mixing devices and can optionally be subjected to pressure, b) pipelines which are provided with valves, laid in a descending manner and, which optionally can be subjected pressure, c) an optional compressed air supply suitable for highly pure chemicals and d) an optional system for supplying highly pure water.

11. A process for the production of wafers or of semiconductor circuits, comprising chemical-mechanical polishing with a polishing suspension, wherein said polishing suspension is supplied from a) storage and working tanks which are connected to one another and which are optionally provided with stirrers or homogeneous mixing devices and, can optionally be subjected to pressure, b) pipelines which are provided with valves, laid in a descending manner and which optionally can be subjected pressure, c) an optional compressed air supply suitable for highly pure chemicals and d) an optional system for supplying highly pure water.

12. The process according to claim 9, wherein i) one or more metered amounts of a solid are introduced in one or more intermediate containers and ii) are converted into a pasty or liquid form with mixing, by adding one or more liquids, and iii) are introduced into one or more storage or working tanks, in which, further chemicals required in the operation have optionally already been placed.

13. The supply system according to claim 1, wherein storage and working tanks are connected to one another in a redundant manner.

14. A supply system for chemicals during chemical-mechanical polishing, comprising a) storage and working tanks containing a paste or liquid comprising a solid material, said paste or liquid being useable for chemical-mechanical polishing, said storage and working tanks being connected to one another and optionally provided with stirrers or homogeneous mixing devices and can optionally be subjected to pressure, b) pipelines connecting said tanks to each other, and to a point of use, in a descending manner and which optionally can be subjected pressure, c) an optional compressed air supply suitable for highly pure chemicals and d) an optional system for supplying highly pure water, whereby said paste or liquid flows from said working tanks to said point of use under the action of gravity, and said paste or liquid can be directed to flow from said working tanks to overflow tanks under the action of gravity.

15. The supply system according to claim 14, further comprising a tank (8) in which paste or liquid slurry is prepared, said tank (8) being fed by a line (3) introducing water, and fed by a storage vessel for solids; and tank (8) connected to working tanks (2) by a line transferring slurry thereto, tanks (2) being connected to and supplying slurry to a ring pipeline, tanks (2) further being connected to tanks (1) to which slurry in tanks (2) can be drained.

* * * * *